US007280011B2

(12) United States Patent
Bayar et al.

(10) Patent No.: US 7,280,011 B2
(45) Date of Patent: Oct. 9, 2007

(54) WAVEGUIDE AND METHOD OF MANUFACTURE

(75) Inventors: Esen Bayar, London (GB); Antony James Booth, York (GB)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/501,889

(22) PCT Filed: Nov. 25, 2002

(86) PCT No.: PCT/GB02/05293

§ 371 (c)(1),
(2), (4) Date: Nov. 30, 2004

(87) PCT Pub. No.: WO03/047023

PCT Pub. Date: Jun. 5, 2003

(65) Prior Publication Data

US 2005/0073463 A1 Apr. 7, 2005

Related U.S. Application Data

(60) Provisional application No. 60/333,117, filed on Nov. 27, 2001.

(51) Int. Cl.
*H01P 1/00* (2006.01)

(52) U.S. Cl. ..... 333/248; 333/208

(58) Field of Classification Search ..... 333/208, 333/248, 210, 31 R, 21 A
See application file for complete search history.

(56) References Cited

U.S. PATENT DOCUMENTS

| | | | | |
|---|---|---|---|---|
| 3,046,503 | A | 7/1962 | Cohn | |
| 3,271,706 | A | 9/1966 | Rooney | |
| 4,034,319 | A | 7/1977 | Olsson | |
| 5,600,740 | A * | 2/1997 | Asfar | 385/27 |
| 6,476,696 | B1 * | 11/2002 | Mack | 333/248 |

FOREIGN PATENT DOCUMENTS

| | | |
|---|---|---|
| EP | 1049192 | 11/2000 |
| EP | 1122808 | 8/2001 |
| FR | 2602114 | 1/1988 |

* cited by examiner

*Primary Examiner*—Stephen E. Jones
(74) *Attorney, Agent, or Firm*—Blakely, Sokoloff, Taylor & Zafman LLP

(57) ABSTRACT

A hollow waveguide (1) has a wall (3) having plural pegs (16) thereon. The pegs (16) which project into the hollow interior of the waveguide (1) such that the waveguide (1) propagates electromagnetic waves only below a certain frequency. The surface of each of the pegs (16) is substantially free of discontinuity and concavities. The waveguide (1) may be manufactured by a moulding process.

10 Claims, 6 Drawing Sheets

WAVEGUIDE AND METHOD OF MANUFACTURE

CROSS REFERENCE TO RELATED APPLICATION

This is the U.S. National Stage of PCT/GB02/05293, filed Nov. 25, 2002, which in turn claims priority to U.S. Provisional Application No. 60/333,117, filed Nov. 27, 2001, both of which are incorporated herein in their entirety by reference.

The present invention relates to a hollow waveguide and to a method of manufacture of a waveguide.

Wireless communications offers many attractive features in comparison with wired communications. For example, a wireless system is very much cheaper to install as no mechanical digging or laying of cables or wires is required and user sites can be installed and de-installed very quickly.

It is a feature of wireless systems when a large bandwidth (data transfer rate) is required that, as the bandwidth that can be given to each user increases, it is necessary for the bandwidth of the wireless signals to be similarly increased. Furthermore, the frequencies which can be used for wireless transmission are closely regulated and it is a fact that only at microwave frequencies (i.e. in the gigahertz (GHz) region) or higher are such large bandwidths now available as the lower radio frequencies have already been allocated.

A "mesh" communications system, which uses a multiplicity of point-to-point wireless transmissions, can make more efficient use of the radio spectrum than a cellular system. An example of a mesh communications system is disclosed in our International patent application WO-A-98/27694, the entire disclosure of which is incorporated herein by reference. In a typical implementation of a mesh communications system, a plurality of nodes are interconnected using a plurality of point-to-point wireless links. Each node is typically stationary or fixed and the node is likely to contain equipment that is used to connect a subscriber or user to the system. The nodes operate in a peer-to-peer manner, each node having apparatus for transmitting and for receiving wireless signals over the plurality of point-to-point wireless links and is arranged to relay data if data received by said node includes data for another node. At least some, more preferably most, and in some cases all, nodes in the fully established mesh of interconnected nodes will be associated with a subscriber, which may be a natural person or an organisation such as a company, university, etc. Each subscriber node will typically act as the end point of a link dedicated to that subscriber (i.e. as a source and as a sink of data traffic) and also as an integral part of the distribution network for carrying data intended for other nodes. The frequency used may be for example at least about 1 GHz. A frequency greater than 2.4 GHz or 4 GHz may be used. Indeed, a frequency of 28 GHz, 40 GHz, 60 GHz or even 200 GHz may be used. Beyond radio frequencies, other yet higher frequencies such as of the order of 100,000 GHz (infra-red) could be used.

Within a mesh communications system, each node is connected to one or more neighbouring nodes by a set of separate point-to-point wireless transmission links. When combined with the relay function in each node, it becomes possible to route information through the mesh by various routes. Information is transmitted around the system in a series of "hops" from node to node from the source node to the destination node. By suitable choice of node interconnections it is possible to configure the mesh to provide multiple alternative routes, thus providing improved availability of service.

A mesh communications system can make more efficient use of the spectrum by directing the point-to-point wireless transmissions along the direct line-of-sight between the nodes, for example by using highly directional beams. This use of spatially directed transmissions reduces the level of unwanted transmissions in other spatial regions and also provides significant directional gain such that the use of spatially directed transmissions as a link between nodes allows the link to operate over a longer range than is possible with a less directional beam. By contrast, a cellular system is obliged to transmit over a wide spatial region in order to support the point-to-multipoint transmissions. This is typically achieved in a cellular system by having a base station of the cellular system transmit a beam that has a very wide beam width in azimuth (typically being a sector of 60 degrees, 120 degrees or omnidirectional) but which is narrow in elevation, i.e. the beam from a base station in a cellular system is typically relatively horizontally flat.

Because the preferred transmission frequency is in the microwave region, waveguides are used to couple the or each antenna with the associated electronics module that constitutes the transceiver electronics unit.

Waveguides typically comprise a conductive envelope which defines conditions that enable the propagation of electromagnetic waves. Typical waveguide configurations include those with a circular, a square or rectangular cross-section transverse to the direction of propagation.

Waveguides having a rectangular or square cross-section are a preferred medium for propagation of waves in the microwave region and design tools are available to enable the propagation characteristics of such waveguides to be set so as to constrain the propagation of waves along the waveguide. The fundamental mode of propagation in a rectangular waveguide is the $TE_{10}$ mode. This fundamental mode has a single field maximum across the width of the waveguide and no maximum along the height direction of the waveguide.

To prevent the waveguide from propagating harmonics and other higher frequencies, transverse slots in the form of corrugations across the width of the waveguide have been used to provide a low pass response to the fundamental mode. However, such arrangements do not effectively attenuate higher order modes of the $TE_{n0}$ type. Higher order modes have two or more maxima across the width of the waveguide. So as to suppress such higher order modes, longitudinal slots have been used.

One known type of filter which provides a low pass characteristic with high-order mode-suppression is the so-called "waffle-iron" filter. Such waffle-iron filters have arrays of identical opposed square pegs projecting from the opposing broad walls of a rectangular waveguide. The arrays of pegs of conventional waffle iron filters are created by conventional machining of two opposed walls which make up the waveguide.

An alternative arrangement is disclosed in JP-A-63/34408. This document discloses a filter having cylindrical pegs which protrude from opposing walls of a waveguide in which each of the pegs has a threaded end which cooperates with a threaded aperture in the waveguide wall. This arrangement allows the propagation characteristic to be varied by screwing the pegs into or out of the walls.

The difficulties of suitable alignment of opposing arrays of raised pegs and the problems of assembly of such devices were recognised in U.S. Pat. No. 3,777,286. This document discloses using die-casting techniques to form generally square cross-section pegs, along with the wall from which the pegs project and part of the side walls of the waveguide.

Where high frequencies are to be propagated, for example above about 10 GHz, it has been believed that the small size of the components concerned, and especially the precision required, necessitates precision machining or spark erosion on an internal surface of the waveguide wall. The physical dimensions of pegs in waveguide filters and similar devices must be tightly defined with stringent tolerances. This has the consequence that conventional waveguide components are very expensive to manufacture using these conventional techniques, which militates against their use in consumer items.

According to a first aspect of the present invention, there is provided a hollow waveguide, the waveguide comprising a wall having plural pegs thereon which project into the hollow interior of the waveguide such that the waveguide propagates electromagnetic waves only below a certain frequency, the surface of each of the pegs being substantially free of discontinuity.

By forming pegs having surfaces that are substantially free of discontinuity, the ability to mould or die-cast pegs in a consistently reproducible fashion is enhanced. It thus becomes possible to form the waveguide by moulding, even though small dimensions may be used, thus allowing mass-production techniques to be used, thereby lowering the manufacturing cost dramatically (e.g. by a factor of 100 or so). Given that one principal intended application of such a waveguide is for use in nodes in a mesh communications system as described above rather than for example in one-off specialist applications, the ability to mass produce the waveguide at low cost is of paramount importance.

The surface of each the pegs is preferably substantially free of concavities. This further enhances the ability to mould the waveguide in a consistent and reproducible manner.

At least some of the pegs may have a substantially circular cross-sectional shape. Preferably, each peg has a substantially circular cross-sectional shape.

Alternatively or additionally, at least some of the pegs have a substantially elliptical cross-sectional shape.

Other cross-sectional shapes are feasible.

At least some of the pegs preferably have a domed head. It has been appreciated that the region on the pegs that is most liable to malformation is the region nearest to the top of the pegs. The use of a domed head, which may for example be part spherical, avoids sharp edges or other discontinuities which might otherwise affect the consistency with which the waveguide can be formed.

At least one peg may have a convex fillet around its base at the junction between the peg and the wall. This feature again helps to avoid sharp edges or other discontinuities which might otherwise affect the consistency with which the waveguide can be formed.

The waveguide may comprise a second wall opposing the first wall and spaced therefrom, the face of the second wall that opposes the first wall being substantially planar.

The waveguide may be dimensioned to propagate electromagnetic waves having a frequency of at least 10 GHz.

The waveguide may be dimensioned to propagate only electromagnetic waves having a frequency less than about 100 GHz.

According to a second aspect of the present invention there is provided a hollow waveguide, the waveguide comprising a wall having plural pegs thereon which project into the hollow interior of the waveguide such that the waveguide propagates electromagnetic waves only below a certain frequency, each peg having a convex fillet around its base at the junction between the peg and the wall.

According to a third aspect of the present invention there is provided a hollow waveguide, the waveguide comprising a wall having plural pegs thereon which project into the hollow interior of the waveguide such that the waveguide propagates electromagnetic waves only below a certain frequency, each peg having a convex head.

According to another aspect of the present invention there is provided transmitter-receiver apparatus, the apparatus comprising at least one antenna for transmitting and receiving signals, an electronics module for providing signals to the antenna for transmission and for receiving signals received by the antenna, and a hollow waveguide as described above selectively coupling the electronics module to the antenna.

According to another aspect of the present invention there is provided a method of manufacture of a hollow waveguide, the waveguide comprising a wall having plural pegs thereon which project into the hollow interior of the waveguide such that the waveguide propagates electromagnetic waves only below a certain frequency, the surface of each of the pegs being substantially free of discontinuity, the waveguide being formed from a waveguide material, the method comprising: disposing a quantity of waveguide material into a mould tool having plural recesses in a surface therein, wherein each recess corresponds to a said peg; moulding the material; and, removing the hollow waveguide from the mould.

The waveguide material may comprise a plastics material. Said plastics material may be metallised plastics material.

Said moulding is preferably pressure die-casting.

According to another aspect of the present invention there is provided a method of manufacture of a hollow waveguide, the waveguide comprising a wall having plural pegs thereon which project into the hollow interior of the waveguide such that the waveguide propagates electromagnetic waves only below a certain frequency, each peg having a convex fillet around its base at the junction between the peg and the wall, the waveguide being formed from a waveguide material, the method comprising: disposing a quantity of waveguide material into a mould tool having plural recesses in a surface therein, wherein each recess corresponds to a said peg; moulding the material; and, removing the hollow waveguide from the mould.

According to another aspect of the present invention there is provided a method of manufacture of a hollow waveguide, the waveguide comprising a wall having plural pegs thereon which project into the hollow interior of the waveguide such that the waveguide propagates electromagnetic waves only below a certain frequency, each peg having a convex head, the waveguide being formed from a waveguide material, the method comprising: disposing a quantity of waveguide material into a mould tool having plural recesses in a surface therein, wherein each recess corresponds to a said peg; moulding the material; and, removing the hollow waveguide from the mould.

Embodiments of the present invention will now be described by way of example with reference to the accompanying drawings, in which.

Figure 1A:
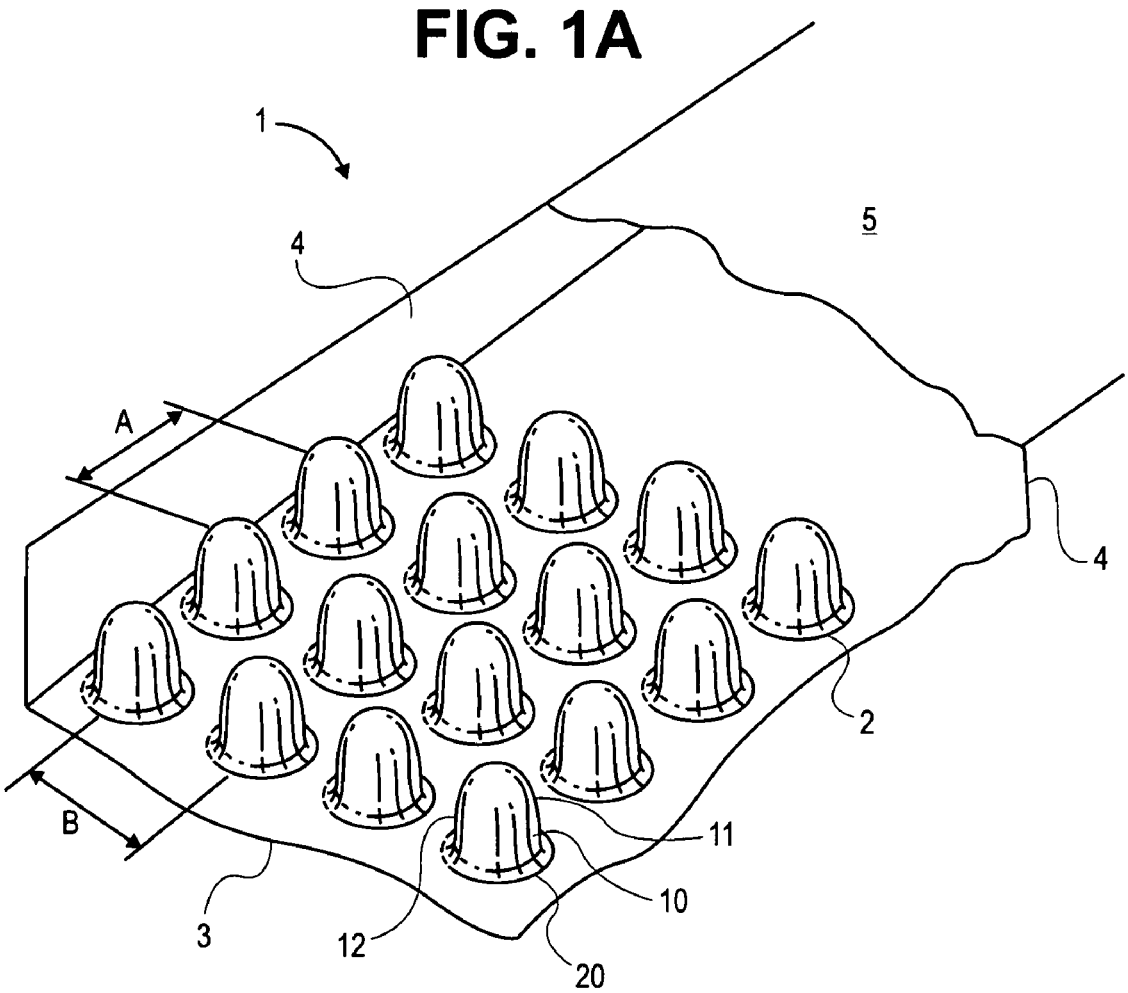
FIG. 1A shows a partial cut-away perspective view of a part of an example of a hollow waveguide in accordance with the present invention.
Figure 1B:
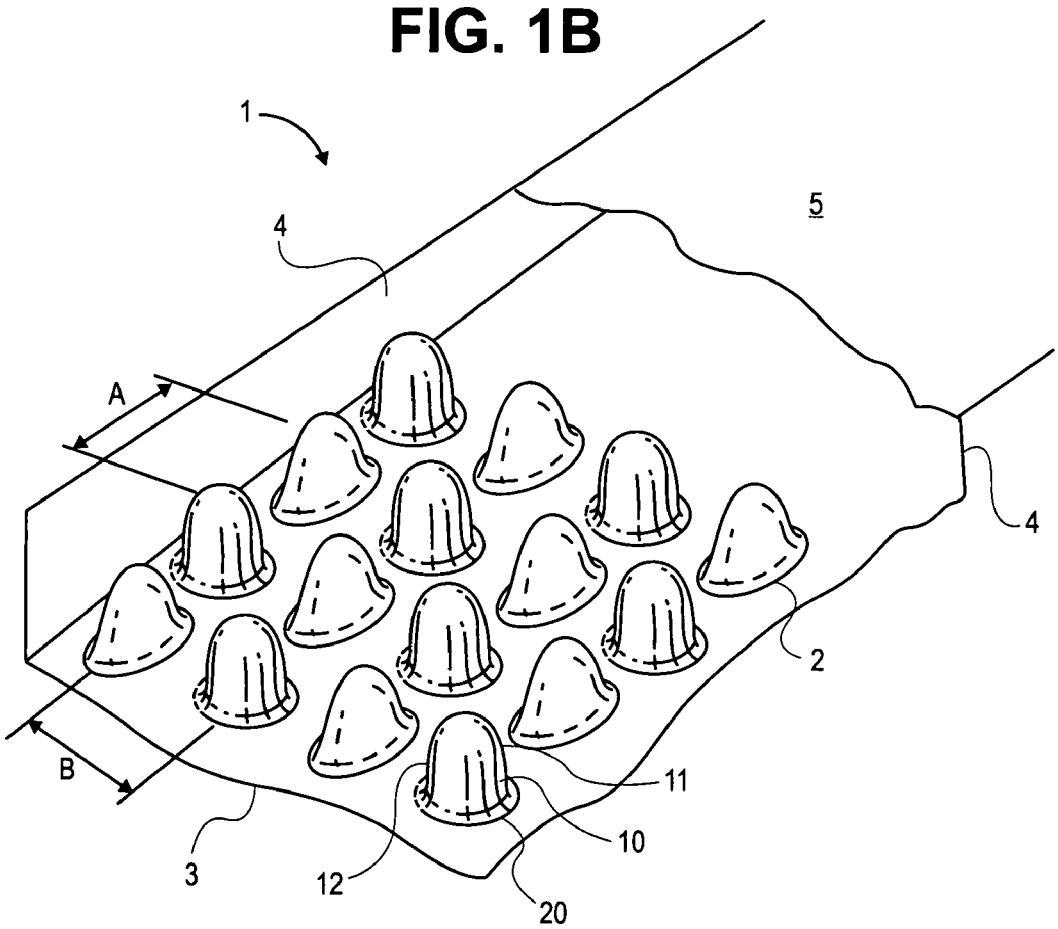
FIG. 1B illustrates an embodiment of the invention with an elliptical cross-sectional shape.

Referring first to FIG. 1A and 1B, an example of a rectangular hollow waveguide 1 has sixteen pegs 2 projecting from a base wall 3 into the hollow interior of the waveguide 1. The waveguide 1 further has side walls 4 and a top wall 5. Each peg 2 is of circular cross-section and has a side wall portion 10 which extends from the base wall 3 of the waveguide 1 via a convex bead or fillet 20. The side wall 10 of each peg 2 extends to a domed head portion 11 of the peg 2. The pegs 2 are disposed in a regular array, the spacing A in the longitudinal direction being selected to provide a low pass response and the spacing B in the transverse direction being selected to suppress higher order propagation modes.

The convex fillets 20 avoid a sharp transition at the base of the pegs 2 between the peg 2 and the wall 3 of the waveguide 1. Such sharp transitions are difficult to mould and very difficult to mould consistently. The provision of an outwardly convex fillet 20 allows for a more easily reproducible shape at the base of the pegs 2 which leads in turn to consistent behaviour between pegs 2 and between waveguides 1. The side walls 10 of the pegs 2 have a generally linear taper from the fillet 20 to a position 12 just under the domed head 11. The domed heads 11 of the pegs 20 are substantially hemispherical in form. Thus, the cross-section of each peg 2 decreases generally linearly with distance from the wall 3 up to the position 12 and thereafter there is a rate of decrease of cross-section which increases with distance from the wall. The transition at the position 12 between the side wall 10 and the domed head 11 is smooth, without sharp edges or other junctions. The use of a domed head 11 again avoids any sharp edges which, again, are difficult to mould and very difficult to mould consistently. For example, it has been found that any attempt to mould say a flat head using mass-moulding techniques tends to produce a pyramid-like head owing to the small dimensions that are required of the pegs when used in a waveguide transmitting frequencies above 10 GHz. The shapes of such pyramids were found to vary significantly between pegs 2 within a waveguide 1 and across different waveguides 1. This is entirely avoided by use of a head which is free of discontinuities and particularly by use of a domed head 11.

Moreover, the arrangement described above avoids any concavities in the surface of the pegs 2, which again makes mass-moulding of the waveguide 1 a realistic proposition even when the waveguide 1 is to be used for propagation of high frequency waves.

Whilst a circular cross-sectional shape is preferred for the pegs 2, other cross-sectional shapes may be used. For example, the cross-sectional shape may be elliptical.

Figure 2:
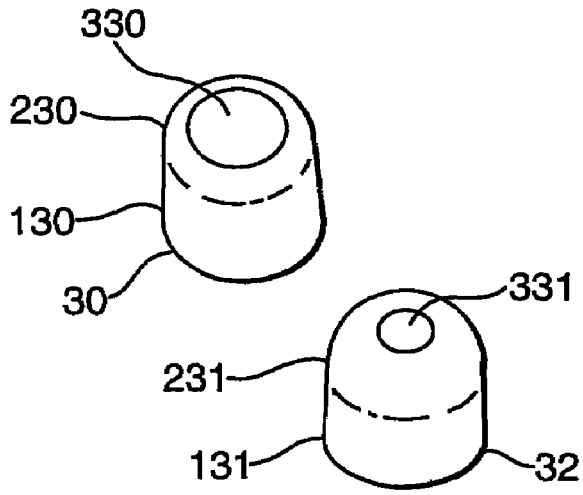
FIG. 2 shows a perspective view of examples of pegs having different shapes.

Referring now to FIG. 2, examples of alternative forms of peg are shown. A peg 30 is shown having a generally-tapering side wall 130 together with a radiussed shoulder portion 230 leading to a flat top 330. In this case, the peg 30 is circular in cross-section with a radius r, the shoulder portion 230 having a radius of 0.2 r. There is also shown another peg 32 which has a side wall 131, a shoulder portion 231 having a radius of 0.4 r, and a flat top portion 331.

Figure 3:
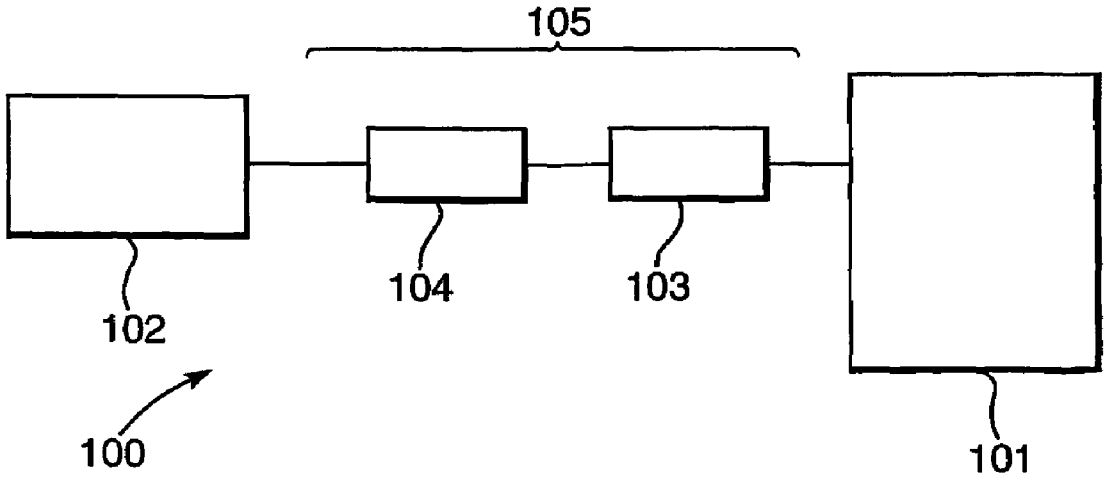
FIG. 3 shows a schematic view of an example of a transmit-receive unit using an embodiment of a hollow waveguide in accordance with an embodiment of the present invention.

Referring now to FIG. 3, an example of a transmit-receive system 100 comprises a transmit-receive antenna 101, such as a horn antenna, a transmit-receive electronics unit 102, and a waveguide module 105, including a matching filter 104 and a low-pass higher-order mode suppression filter 103, coupling the electronics unit 102 and the antenna 101. The low-pass higher-order mode suppression filter 103 is constituted by a waveguide 1 of the type described above. Only one path is shown between the electronics unit 102 and the antenna 101, but in practice two or more separate paths may be provided.

The transmit-receive system 100 of the preferred embodiment is designed to operate at above about 10 GHz, and in a more preferred embodiment propagates frequencies in the Ka band of between about 20 GHz and about 40 GHz. In other embodiments, propagation at about 25 to about 30 GHz is envisaged. A preferred operating frequency is about 28 GHz. The pass characteristics of the waveguide 1 are preferably selected so as to reject frequencies of about 100 GHz upwards and more preferably to reject frequencies of about 50 to 60 GHz upwards, these being the re-entrance modes at twice the operating frequencies.

The wavelength of a 10 GHz signal is 3 cm and the wavelength of a 28 GHz is just over 1 cm. It will be clear to those skilled in the art that these wavelengths determine the dimensions of the waveguide 1.

In one preferred embodiment, the width of the waveguide 1 is 7.11 mm, and the height is 3.56 mm. Pegs of the filter are 1.5 mm in height, have a base radius of 0.67 mm and are spaced by 2.66 mm in the longitudinal direction and 2.66 mm in the transverse direction. In this embodiment, manufacturing tolerances are restricted to ±25 μm.

Figure 4:
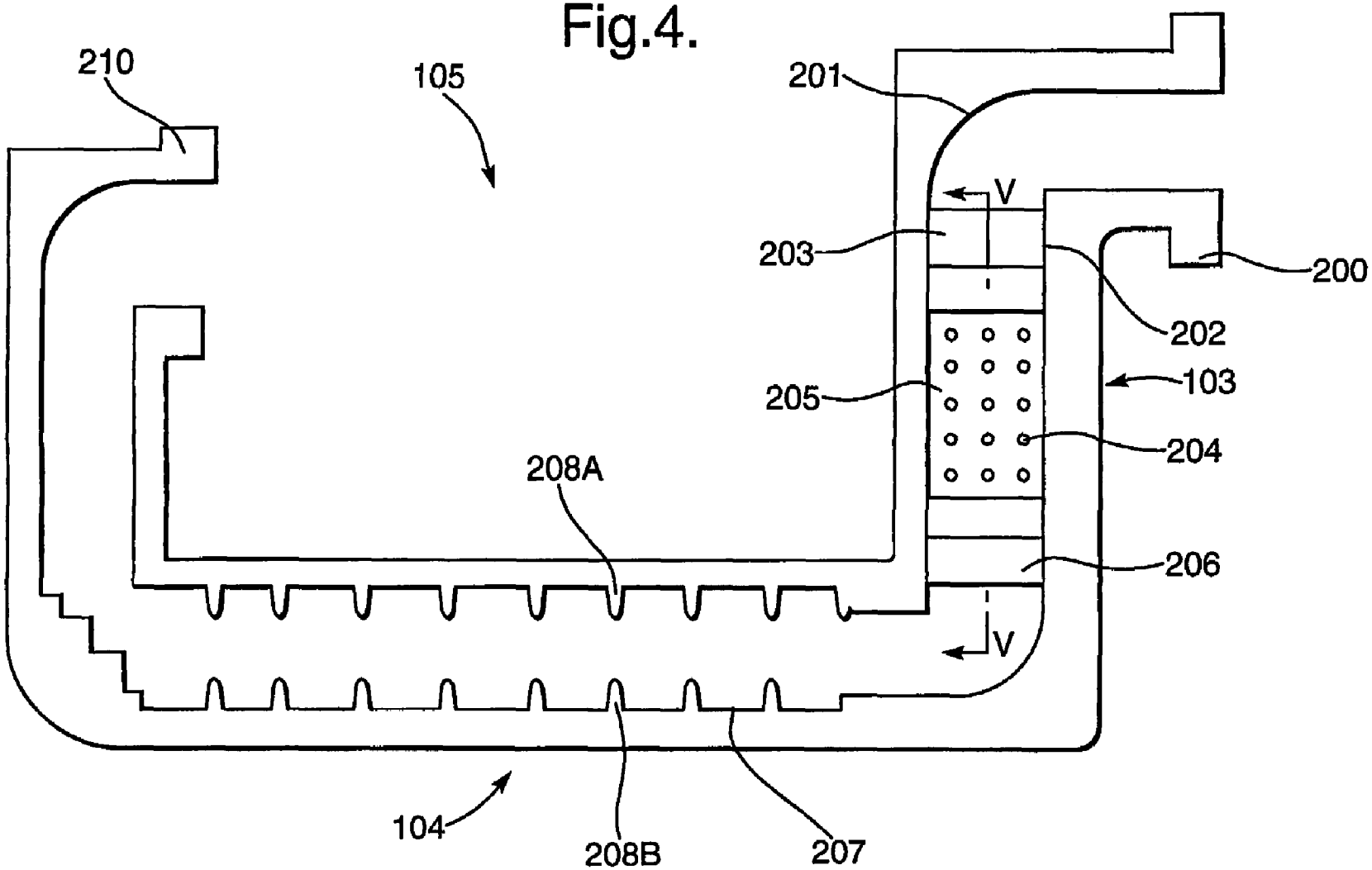
FIG. 4 shows a cut-away view of the hollow waveguide of FIG. 3.

Referring now to FIG. 4, the waveguide module 105 has a first flange 200 which has a rectangular opening for attachment to the antenna 101. At the end of an initial straight section, a first side wall 201 of the waveguide module 105 is gently radiussed and passes through a right angle and a second, opposed side wall 202 has a sharp radius and again passes through a right angle so as to emerge parallel with the first side wall 201. Passing along the waveguide module 105, a second straight section of the waveguide module 105 has a step transformer or down-taper 203 and then a filter 103 constituted by a waveguide 1 of the type described above. In this example, the waveguide filter 103 has an array of fifteen pegs 204 projecting from a base wall 205. The array of pegs 204 is in turn followed by a second step transformer or up-taper 206 which leads to a second right angle bend. The second right angle bend, formed from a sharp turn in the first side wall 201 and a radiussed turn in the second side wall 202, leads to a third straight waveguide section. The third straight section is parallel to the initial straight section and has walls shaped to form an iris filter device 207, constituting a matching or decoupling filter 104. The filter 104 has eight opposed iris pairs 208A, 208B which project inwardly from the side walls 201, 202 of the waveguide module 105. At the end of the third straight section, the walls 201, 202 lead to a further right angle bend to a fourth straight section parallel to the second section. This leads via a further right angle bend to a second flange 210 opening in the same general direction as the first flange 200. The second flange 210 is secured to the transmit-receive electronics unit 102.

Figure 5:
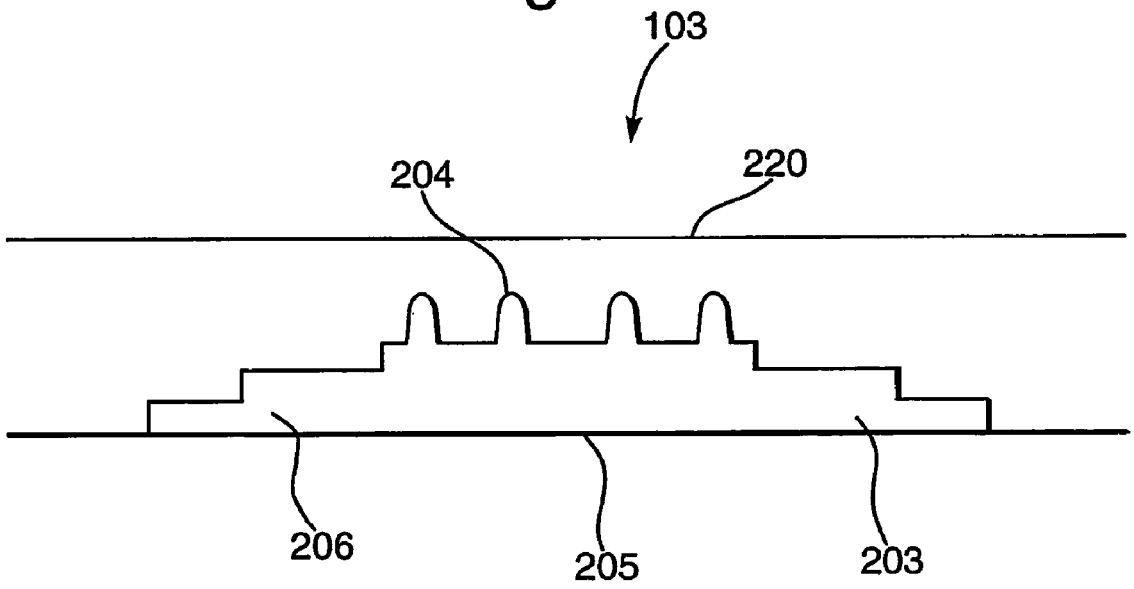
FIG. 5 shows a cross-section through the waveguide of FIG. 4 along the line V-V; and, FIG. 6 is a longitudinally sectioned perspective view of an example of transceiver apparatus suitable for use in a mesh communications system.

Referring now to FIG. 5, which is a cross-section on V-V of FIG. 4, the waveguide module 105 has a top wall 220 which opposes the base wall 204. It will be seen that the step transformer or down-taper 203 reduces the height of the waveguide module 105 substantially in the region of the filter 103 so that the tops of the pegs 204 of the filter 103 are relatively close to the top wall 220. The following up-taper or step transformer 206 restores the height of the waveguide module 105. Although the embodiment shown in FIGS. 4 and 5 has only a single array of pegs 204 co-operating with a planar top wall 220, it will be understood that two opposed sets of pegs could be provided instead with one set being on the base wall 204 and the other on the top wall 220.

Figure 6:
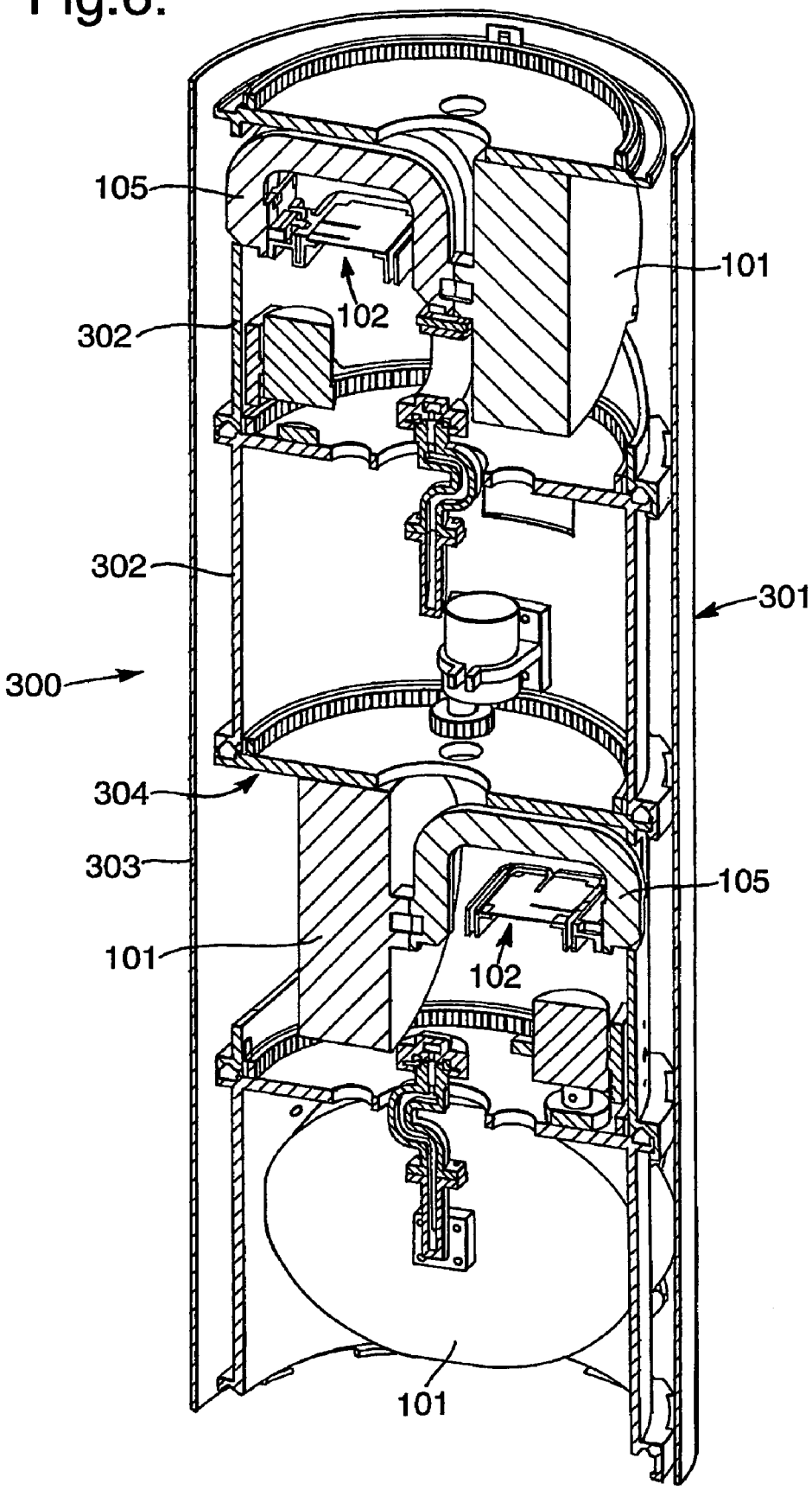

FIG. 6 shows an example of transceiver apparatus 300 suitable for use in a mesh communications system as described above. A generally columnar support structure 301 supports four antennas 101. This support structure 301 is more fully described in our WO-A-02/50950, the entire disclosure of which is hereby incorporated by reference. Each antenna 101 of this example is suitable for the transmission and reception of radio or higher frequencies, typically at 1 GHz or higher frequencies, such as 2.4 GHz, 4 GHz, 28 GHz, 40 GHz, 60 GHz or even 200 GHz; beyond radio frequencies, other yet higher frequencies such as of the order of 100,000 GHz (infra-red) could be used. In use, the support structure 301 will normally be orientated vertically so that its central longitudinal axis is vertical and each antenna 101 is therefore normally arranged to transmit and receive in a direction that is substantially centred in elevation on the horizontal plane, i.e. typically within about ±5° of the horizontal plane.

Each antenna 101 is mounted in its own antenna support 302. In the example shown, there are four antenna supports 302 each for supporting a respective antenna 101. For economy of manufacture, it is preferred that all antenna supports 302 be substantially identical (i.e. constructionally and/or functionally the same as each other except for minor or inconsequential differences, including those that might arise through variations in the manufacturing process). Each antenna support 302 of this example is generally in the form of a hollow cylinder of circular cross-section. Each antenna support 302 is able to rotate about an axis of rotation which in use is vertical. The cylindrical side wall of each antenna support 302 is recessed on one side to receive an antenna 101 and is provided with screw fixing holes which can receive screws for fixing the antenna 101 to the antenna support 302. In this example, an external radome 303 surrounds the antenna supports 302.

Neighbouring antenna supports 302 are connected together via a bearing 304 which is provided at the junction between the neighbouring antenna supports 302 and which allows the neighbouring antenna supports 302 to rotate relative to each other.

In the example shown in FIG. 6, a single transceiver unit 102 is contained in every other antenna support 302. Typically, the transceiver units 102 will be radio modules. The transceiver units 102 contain all of the necessary circuitry to allow signals to be transmitted and received via the antennas 102. Each transceiver unit 102 services the antenna 101 provided in the same antenna support 302 as well as the antenna 101 provided in a neighbouring antenna support 302 (in the example shown, the lower neighbouring antenna support 302). In the example shown in which the wireless transmissions to and from the antennas 101 are at microwave frequencies (approximately 1 GHz or higher), waveguides 105, preferably as described above, are provided to connect the radio module 102 to the respective antennas 101. The preferred waveguides 105 provide a low pass frequency filtering function and act to suppress higher mode propagation, as discussed in more detail above.

The manufacture of a hollow waveguide in accordance with the preferred embodiment of the present invention follows conventional moulding or die-casting techniques. That is, a mould is provided and moulding material is applied to the mould, preferably under pressure, to form the waveguide. The shape of the moulding tool is designed to allow release of the product from the tool by virtue of the previously-discussed shapes.

The moulding or die-casting material may be a metal, or a metal alloy. It is also possible to form the device by metallised plastics moulding, i.e. by moulding the waveguide in plastics and then coating the waveguide with metal.

Embodiments of the present invention have been described with particular reference to the examples illustrated. However, it will be appreciated that variations and modifications may be made to the examples described within the scope of the present invention.

The invention claimed is:

1. A hollow waveguide, the waveguide comprising a wall having plural pegs thereon which project into the hollow interior of the waveguide such that the waveguide propagates electromagnetic waves only below a certain frequency, the surface of each of the pegs being substantially free of discontinuity and wherein at least some of the pegs have a substantially elliptical cross-sectional shape.

2. A wave guide according to claim 1, wherein the surface of each the pegs is substantially free of concavities.

3. A waveguide according to claim 1, wherein at least some of the pegs have a substantially circular cross-sectional shape.

4. The hollow waveguide of claim 1, wherein each of the plural pegs has a convex head.

5. A waveguide according to claim 1, wherein the waveguide is dimensioned to propagate only electromagnetic waves having a frequency less than about 100 GHz.

6. A waveguide according to claim 1, wherein at least some of the pegs have a domed head.

7. A waveguide according to claim 1, wherein at least one peg has a convex fillet around its base at the junction between the peg and the wall.

8. A waveguide according to claim 1, comprising a second wall opposing the first wall and spaced therefrom, the face of the second wall that opposes the first wall being substantially planar.

9. A waveguide according to claim 1, wherein the waveguide is dimensioned to propagate electromagnetic waves having a frequency of at least 10 GHz.

10. Transmitter-receiver apparatus, the apparatus comprising:

at least one antenna for transmitting and receiving signals, an electronics module for providing signals to the antenna for transmission and for receiving signals received by the antenna, and a hollow waveguide selectively coupling the electronics module to the antenna, the waveguide having a wall having plural pegs thereon which project into the hollow interior of the waveguide such that the waveguide propagates electromagnetic waves only below a certain frequency, the surface of each of the pegs being substantially free of discontinuity and wherein at least some of the pegs have a substantially elliptical cross-sectional shape.

* * * * *